US010301791B2

(12) United States Patent
Andrina

(10) Patent No.: US 10,301,791 B2
(45) Date of Patent: May 28, 2019

(54) ASSEMBLY COMPOSED OF A TOOL, A HANDLING APPARATUS AND A QUICK COUPLING DEVICE BETWEEN TOOL AND APPARATUS

(71) Applicant: Giovanni Andrina, Bosconero (IT)

(72) Inventor: Giovanni Andrina, Bosconero (IT)

( * ) Notice: Subject to any disclaimer, the term of this patent is extended or adjusted under 35 U.S.C. 154(b) by 589 days.

(21) Appl. No.: 15/072,614

(22) Filed: Mar. 17, 2016

(65) Prior Publication Data

US 2016/0273184 A1 Sep. 22, 2016

(30) Foreign Application Priority Data

Mar. 17, 2015 (IT) ..... TO2015A0173

(51) Int. Cl.
*E02F 3/36* (2006.01)

(52) U.S. Cl.
CPC ..... *E02F 3/3609* (2013.01); *E02F 3/364* (2013.01); *E02F 3/3613* (2013.01); *E02F 3/3659* (2013.01); *E02F 3/3663* (2013.01)

(58) Field of Classification Search
CPC ..... E02F 3/3609; E02F 3/3613; E02F 3/364; E02F 3/3659; E02F 3/3663
See application file for complete search history.

(56) References Cited

U.S. PATENT DOCUMENTS 4,663,866 A * 5/1987 Karlsson ..... E02F 3/3663 172/272
5,394,630 A * 3/1995 Moinat ..... E02F 3/364 172/272
6,499,904 B2 * 12/2002 Nye ..... E02F 3/364 37/468
7,296,961 B2 * 11/2007 Segerljung ..... B66F 9/143 37/468
8,007,197 B2 * 8/2011 Nye ..... E02F 3/3636 37/468
8,528,239 B2 * 9/2013 Andrina ..... E02F 3/3613 37/468
2002/0098032 A1 * 7/2002 Nye ..... E02F 3/364 403/31

(Continued)

FOREIGN PATENT DOCUMENTS

DE 8700947 U1 5/1987
EP 0312489 A1 * 4/1989 ..... E02F 3/364

(Continued)

*Primary Examiner* — Matthieu F Setliff

(74) *Attorney, Agent, or Firm* — Macheledt Bales LLP; Jennifer L. Bales

(57) ABSTRACT

An assembly includes a tool equipped with a quick coupling device and a handling apparatus equipped with a coupling element which is adapted to be coupled with the quick coupling device. The quick coupling device includes a supporting structure, a first engagement element having two, "V"-shaped elongated arms and is connected to a second "V"-shaped engagement element with which the coupling element is equipped, a first hydraulic connection adapted to perform the hydraulic connection between tool and handling apparatus at the end of the mechanical coupling between the coupling element and the engagement element, and two or more elements enabling the mechanical coupling between the device and the handling apparatus.

7 Claims, 7 Drawing Sheets

(56) References Cited

U.S. PATENT DOCUMENTS

| | | | | |
|---|---|---|---|---|
| 2006/0130474 | A1* | 6/2006 | Segerljung | B66F 9/143 60/476 |
| 2009/0255151 | A1 | 10/2009 | Wimmer et al. | |
| 2010/0189535 | A1* | 7/2010 | Nye | E02F 3/3636 414/723 |
| 2011/0252673 | A1* | 10/2011 | Andrina | E02F 3/3613 37/468 |

FOREIGN PATENT DOCUMENTS

| | | | | |
|---|---|---|---|---|
| EP | 0609176 | A1 * | 8/1994 | E02F 3/364 |
| EP | 0609176 | B1 * | 9/1996 | E02F 3/364 |
| EP | 1353011 | | 3/2002 | |
| EP | 2378004 | | 10/2011 | |
| FR | 2683239 | | 4/1991 | |
| JP | 06064885 | A * | 3/1994 | E02F 3/364 |
| JP | 2000104276 | A * | 4/2000 | E02F 3/3613 |
| SU | 996650 | A1 * | 2/1983 | E02F 3/3609 |

* cited by examiner

ASSEMBLY COMPOSED OF A TOOL, A HANDLING APPARATUS AND A QUICK COUPLING DEVICE BETWEEN TOOL AND APPARATUS

BACKGROUND OF THE INVENTION

1) Field of the Invention

The present invention refers to an assembly composed of a tool, a handling apparatus and a quick coupling device between tool and apparatus.

2) Background Art

The Applicant of the present invention has filed, on 8 Mar. 2011, Patent Application EP2378004 related to a quick coupling device to connect a tool to a handling apparatus, such as the arm of an excavator.

Such device successfully operates for the application for which it is provided: in time, however, it has been discovered that its operation could be highly improved as regards accuracy and operating quickness; moreover, it has been noted that such device could be used in rather different and wider application fields with respect to excavators, such as for example agriculture.

Documents EP-A1-1 353 011 and US-A1-2009/255151 respectively disclose a quick coupling device according to part of the preamble of Claim 1, and an apparatus equipped with a hydraulic connection circuit.

SUMMARY OF THE INVENTION

Object of the present invention is therefore solving the above prior art problems, by providing an assembly composed of a tool, a handling apparatus and a quick coupling device between tool and apparatus, which allows quick, reliable and accurate coupling movements.

A further object of the present invention is providing a device as mentioned above which can be used in other fields of application, for example in the agricultural field for ploughs with agricultural/industrial tractors and telescopic lifting machines/fork lift truck.

The above and other objects and advantages of the invention, as will appear from the following description, are obtained with an assembly composed of a tool, a handling apparatus and a quick coupling device between tool and apparatus as claimed in claim 1.

Preferred embodiments and non-trivial variations of the present invention are the subject matter of the dependent claims.

It is intended that the enclosed claims are an integral part of the present description.

It will be immediately obvious that numerous variations and modifications (for example related to shape, sizes, arrangements and parts with equivalent functionality) can be made to what is described, without departing from the scope of the invention, as appears in the enclosed claims.

BRIEF DESCRIPTION OF THE DRAWINGS

The present invention will be better described by some preferred embodiments thereof, provided as a non-limiting example, with reference to the enclosed drawings, in which.

DETAILED DESCRIPTION OF PREFERRED EMBODIMENTS

Figure 1:
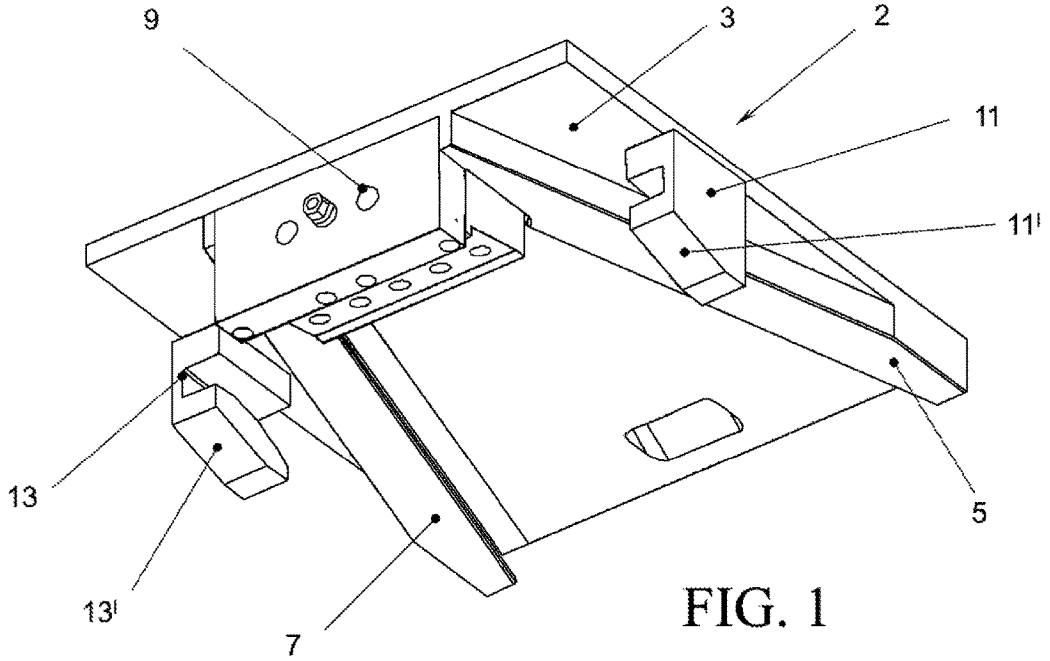
FIG. 1 is a bottom perspective view of an embodiment of the quick coupling device of the present invention.
Figure 2:
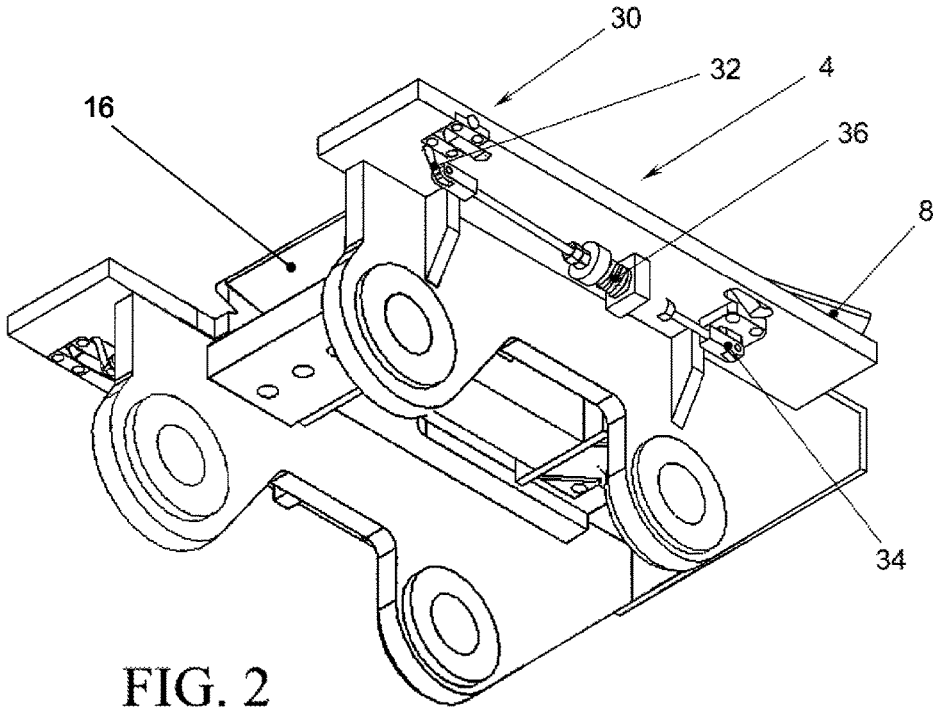
FIG. 2 is a bottom perspective view of part of an handling apparatus adapted to be coupled with the device of FIG. 1.
Figure 3:
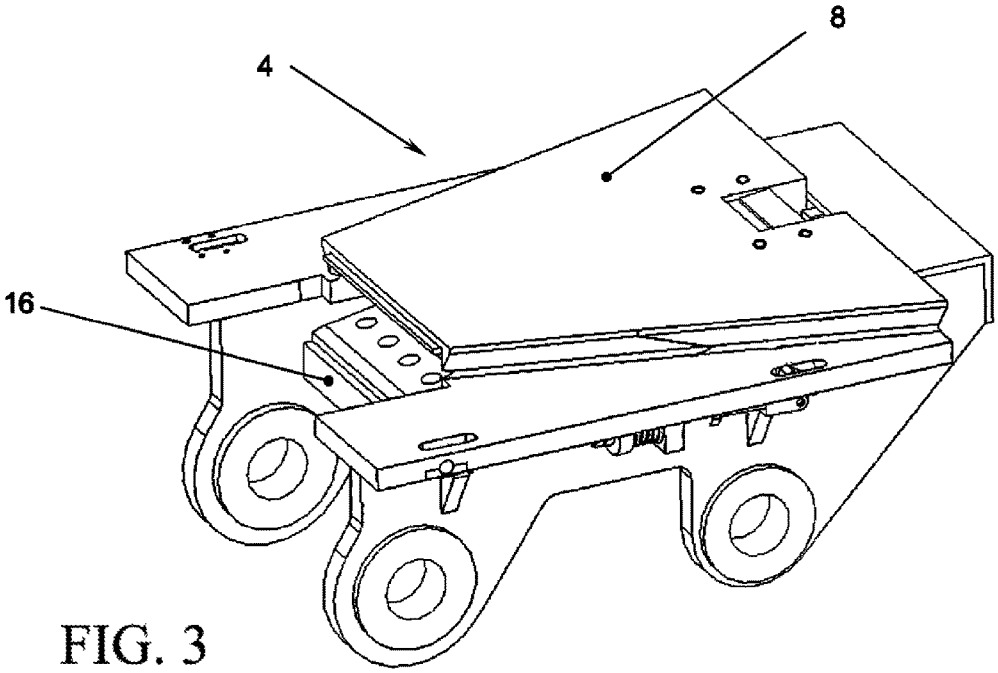
FIG. 3 is a side perspective view which shows an embodiment of the assembly composed of a tool, a part of the handling apparatus as in Figure and a quick coupling device as in FIG. 1 according to the invention.
Figure 4:
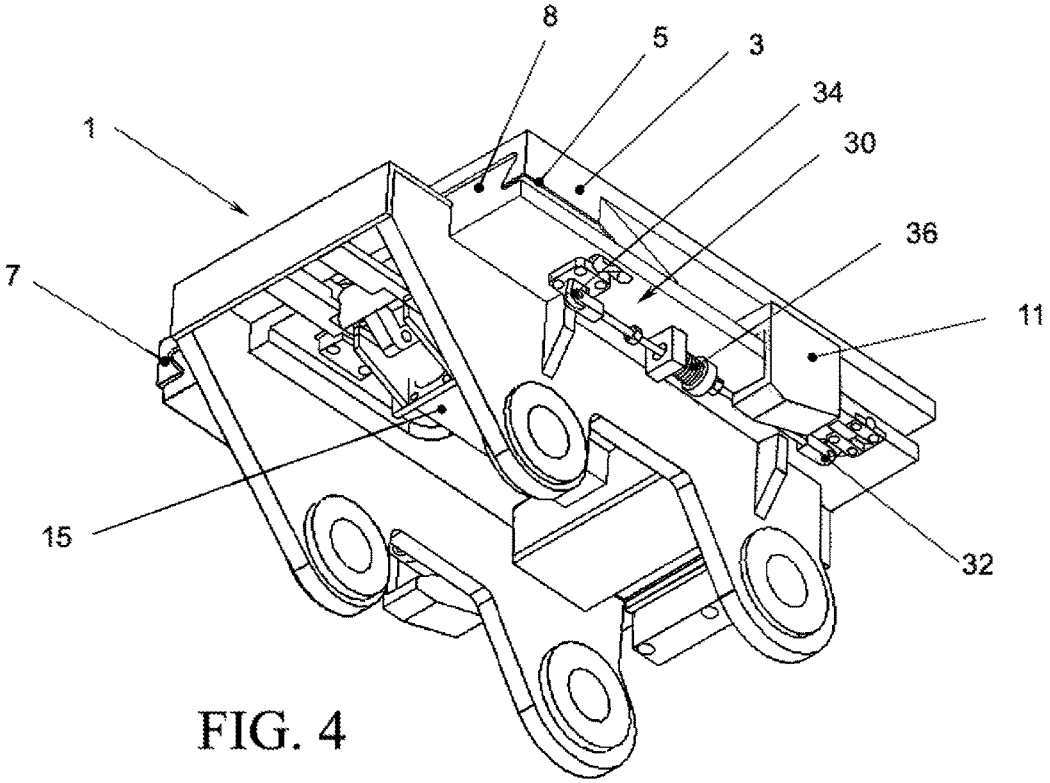
FIG. 4 is a bottom perspective view of FIG. 3.
Figure 5:
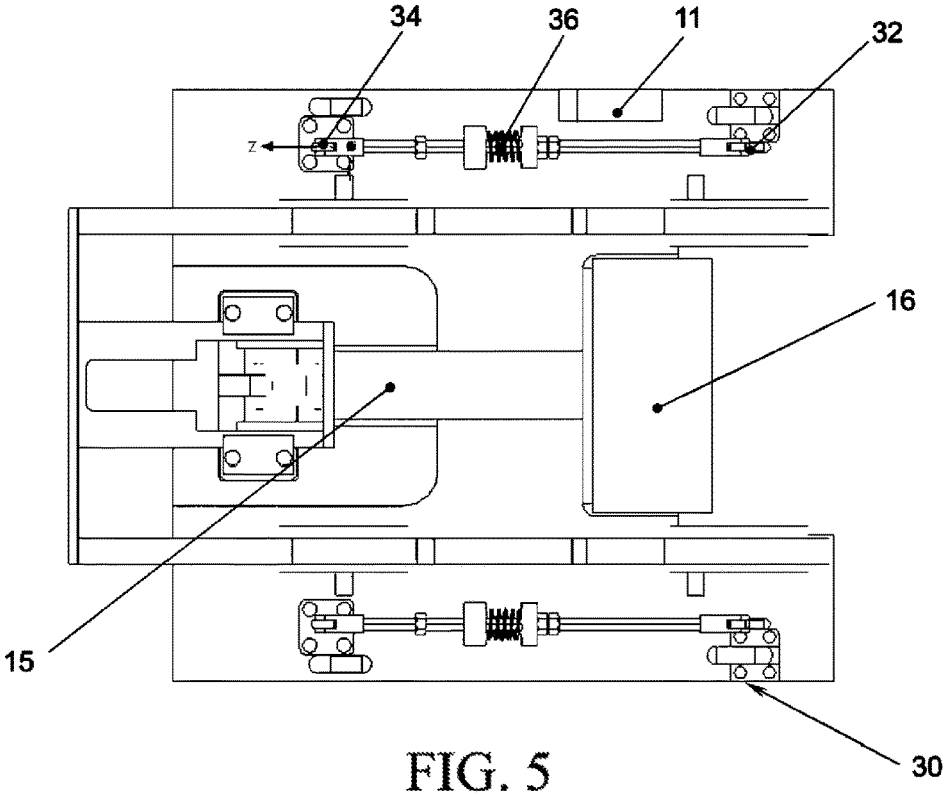
FIG. 5 is a bottom view of FIG. 4.

With reference to the Figures, an example and absolutely not limiting embodiment of the assembly of the invention is shown and described, the assembly 1 being composed of a tool equipped with a quick coupling device 2, and a handling apparatus equipped with a coupling element 4 adapted to be coupled with the quick coupling device 2.

As regards the details of the quick coupling device 2, reference can be made as a whole to the contents of document EP2378004.

Such quick coupling device 2 substantially comprises:

a supporting structure 3;

a first engagement element 5, 7 connected to the supporting structure 3 and composed of two elongated arms 5, 7, whose longitudinal axes are converging to form a "V" to obtain an easy and unmovable connection with a second engagement element 8, also shaped as a "V", with which the coupling element 4 of the handling apparatus is equipped;

first hydraulic connection means 9 connected to the supporting structure 3 and to the engagement element 5, 7 from the part where the two arms 5, 7 of the "V" are nearest, wherein the first hydraulic connection means 9 are adapted to perform the hydraulic connection between tool and handling apparatus at the end of the mechanical coupling between coupling element 4 and engagement element 5, 7; and at least two enabling elements 11, 13 of the mechanical coupling between device 1 and handling apparatus, wherein the enabling elements 11, 13 are connected to the supporting structure 3 on at least two opposed sides thereof and each one next to each of the arms 5, 7.

In particular, as shown, in order to operate at beast, each of the enabling elements 11, 13 has a cross section shaped as a "C", one of the shorter sides of the "C" being connected to the supporting structure 3 and the other one of the shorter sides of the "C" being longitudinally slanted in order to form a surface for helping the connection with the central recess of the "C".

Moreover, the coupling element 4 is equipped with at least one cylinder 15 and with second hydraulic connection means 16, wherein the cylinder is adapted to take in an operating connection position the second hydraulic connection means 16 with the first hydraulic connection means 9 at the end of the mechanical connection between tool and handling apparatus.

As shown, the connection between the first and the second hydraulic connection means 9, 16 is performed through engagement elements 38, which also guarantee the final unmovable connection, since, at the end of it, it is then necessary to activate an hydraulic circuit 40 for the operation of the complete assembly 1, when such hydraulic operation is provided.

Moreover, the coupling element 4 is equipped with holding means 30 of the final connection, which can be composed (as shown in a non-limiting way) of at least one first tooth 32 and at least one second tooth 34 adapted to be taken to their operating holding position by elastic means 36, preferably of the spring type.

Figure 6:
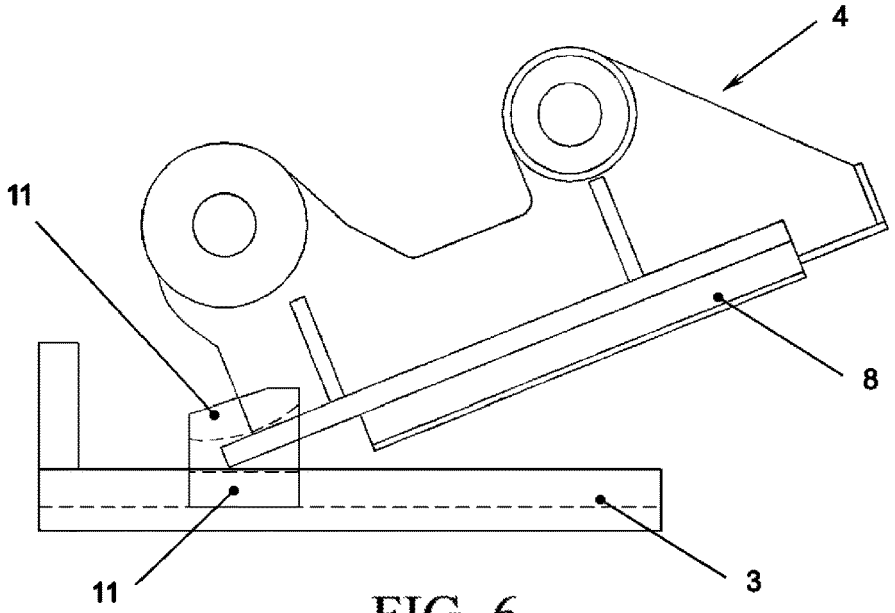
FIGS. 6 to 14 show various operating steps of the assembly of the present invention.
Figure 7:
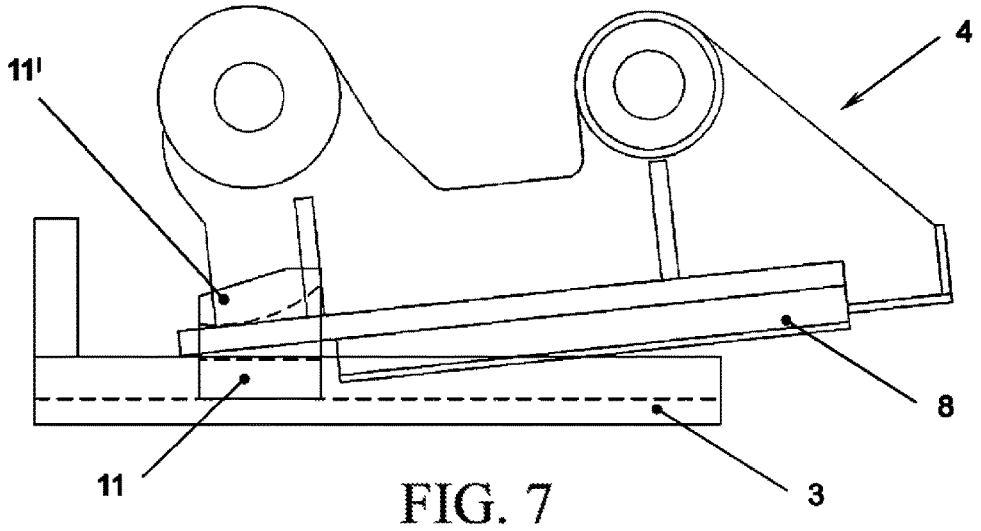
Figure 8:
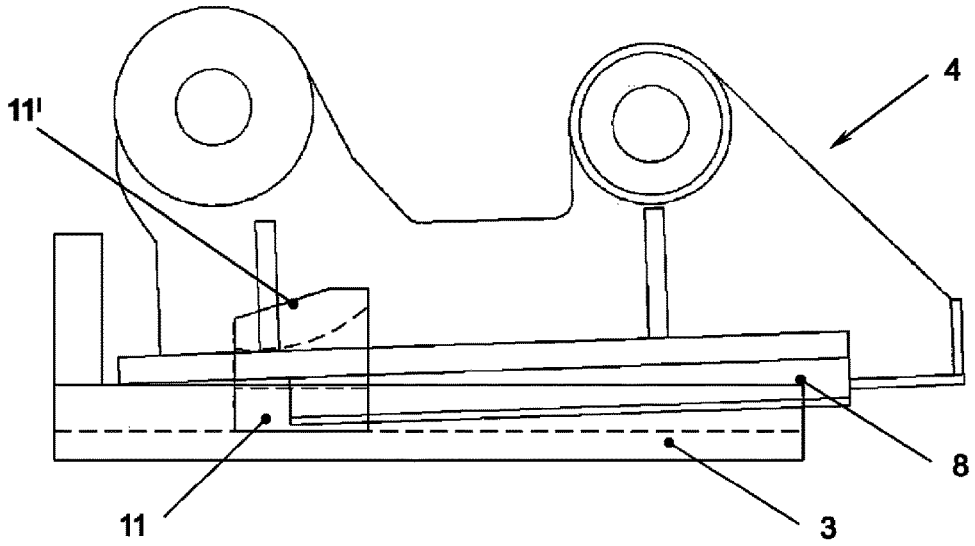
Figure 9:
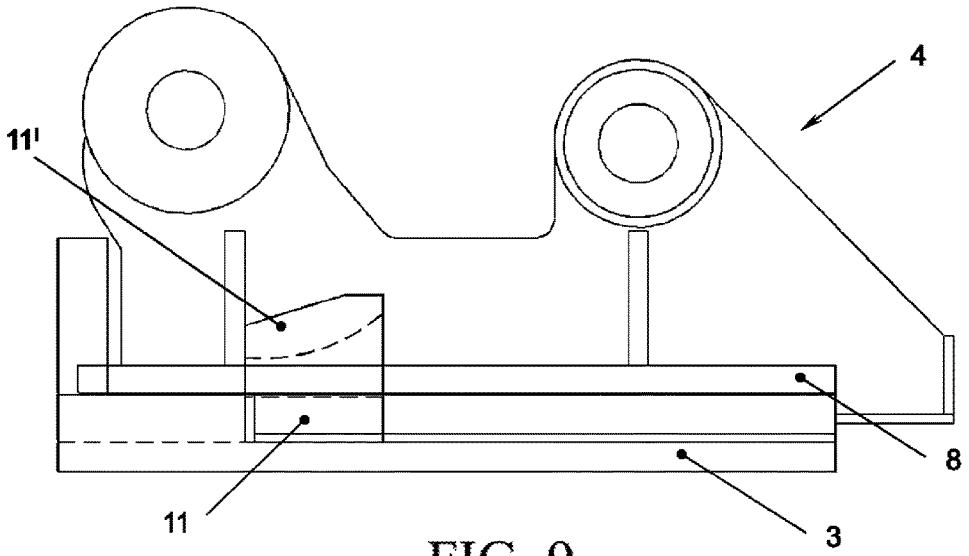
Figure 10:
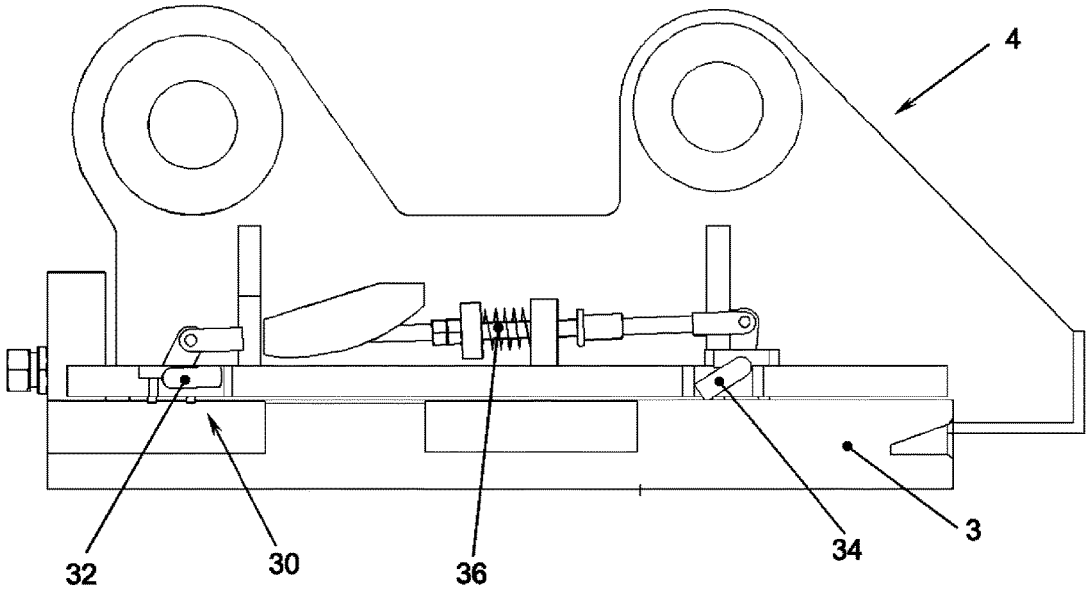

FIGS. 6 to 9 clearly show the three connection (and, on the other way, disconnection) operations enabled by the enabling elements 11, 13.

Figure 11:
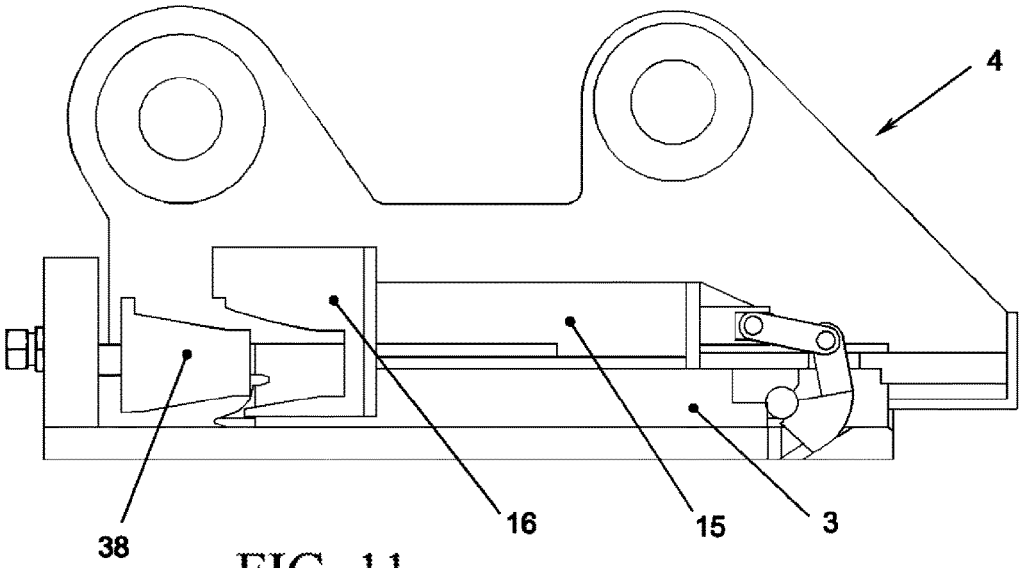
Figure 12:
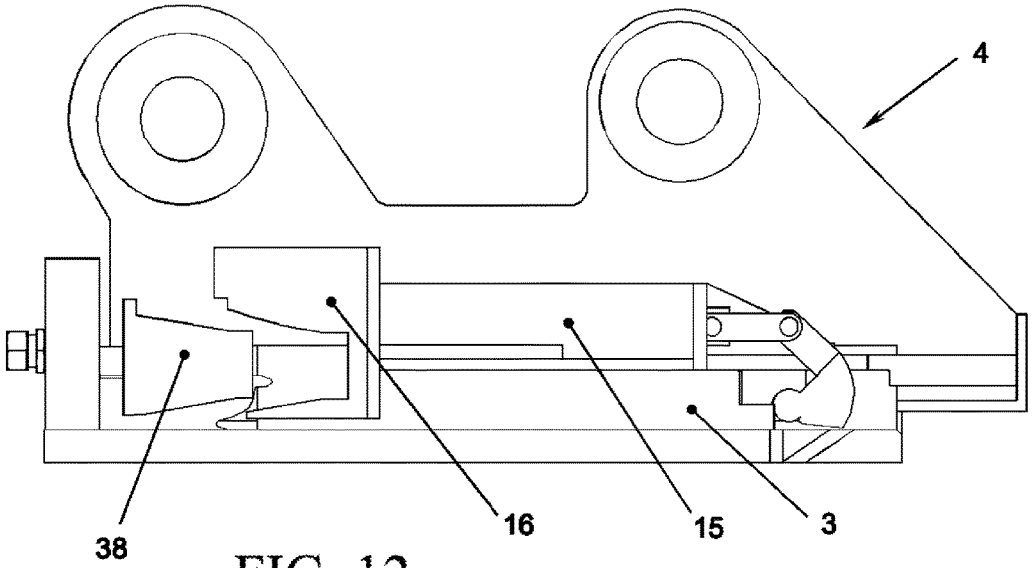
Figure 13:
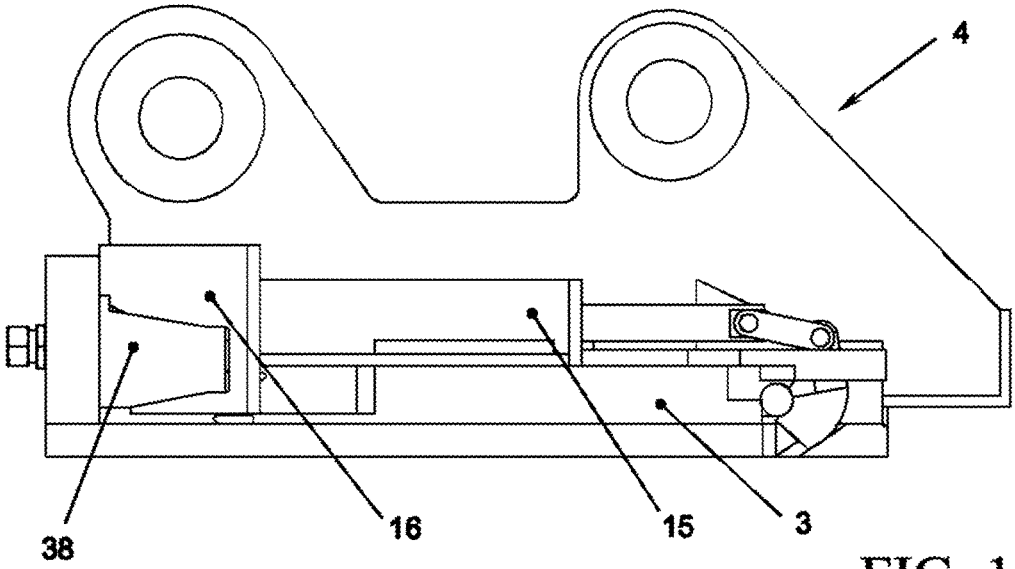
Figure 14:
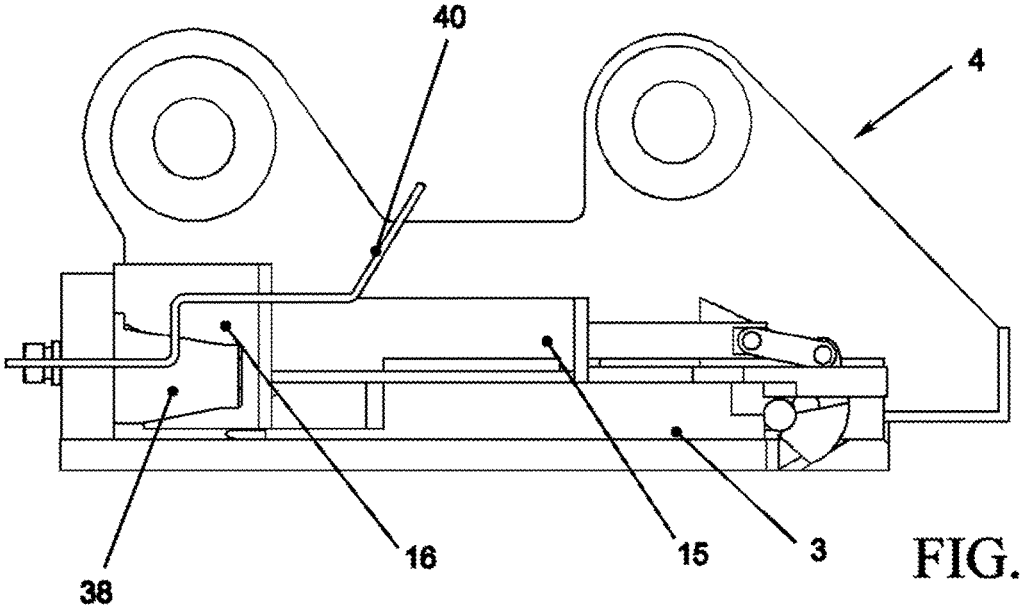

FIGS. 11 to 14, instead, show the operation of the cylinder 15 in guaranteeing the operating connection in case of an hydraulic circuit to be activated.

In the above-described structure, the assembly 1 of the invention is thereby adapted to be used in many different applications, among which the currently known ones provide as follows:

the handling apparatus is composed of an excavator and the tool is composed of a toothed excavating shovel;

the tool is composed of a road demolishing hammer;

the handling apparatus is composed of an agricultural or industrial tractor, the tool is composed of a plough and the coupling element is composed of a cardan joint with which the head of the plough is equipped; and the handling apparatus is composed of a telescopic lifting machine or a fork lift truck.

I claim:

1. An assembly including a tool equipped with a quick coupling device, and a handling apparatus equipped with a coupling element for coupling with the quick coupling device, the quick coupling device comprising:

a supporting structure;

a first engagement element connected to the supporting structure and comprising two elongated arms, whose longitudinal axes are converging to form a "V" to obtain an easy and unmovable connection with a second engagement element shaped as a "V" with which the coupling element of the handling apparatus is equipped;

first hydraulic connection means connected to the supporting structure and to the engagement element on a part where the two elongated arms of the "V" are nearest, the first hydraulic connection means being constructed and arranged to perform a hydraulic connection between tool and handling apparatus after a mechanical coupling is performed between coupling element and engagement element; and at least two enabling elements of the mechanical coupling between the device and the handling apparatus, the enabling elements being connected to the supporting structure on at least two opposed sides thereof and each one next to each of the elongated arms and being adapted to enable a reception and contain a base of the coupling element on which the engagement element abuts after a mechanical coupling is performed between coupling element and engagement element;

wherein each of the enabling elements has a cross section shaped as a "C", one of the shorter sides of the "C" being connected to the supporting structure and the other one of the shorter sides of the "C" being longitudinally slanted in order to form a surface for helping a connection with a central recess of the "C".

2. The assembly of claim 1, wherein the coupling element is equipped with at least one cylinder and with second hydraulic connection means, the cylinder being constructed and arranged to take to an operating connection position the second hydraulic connection means with the first hydraulic connection means after a mechanical connection between tool and handling apparatus.

3. The assembly of claim 2, further comprising a mechanical connection between the first and the second hydraulic connection means including engagement elements.

4. The assembly of claim 2, wherein the coupling element is further equipped with holding means of a final connection, the holding means comprising at least one first tooth and at least one second tooth constructed and arranged to be taken to the operating holding position by elastic means.

5. The assembly of claim 4, wherein the elastic means is a spring.

6. The assembly of claim 1, wherein the coupling element is further equipped with holding means of a final connection, the holding means comprising at least one first tooth and at least one second tooth constructed and arranged to be taken to the operating holding position by elastic means.

7. The assembly of claim 6, wherein the elastic means is a spring.

* * * * *